US009926728B2

(12) United States Patent
Promutico et al.

(10) Patent No.: US 9,926,728 B2
(45) **Date of Patent: *Mar. 27, 2018**

(54) SYSTEM FOR OPENING A DOOR, IN PARTICULAR FOR THE DOOR OF A HOUSEHOLD APPLIANCE

(71) Applicant: BITRON S.p.A., Turin (IT)

(72) Inventors: Fabrizio Promutico, Turin (IT); Felice Paglia, Turin (IT)

(73) Assignee: BITRON S.p.A., Turin (IT)

( * ) Notice: Subject to any disclaimer, the term of this patent is extended or adjusted under 35 U.S.C. 154(b) by 551 days.

This patent is subject to a terminal disclaimer.

(21) Appl. No.: 13/851,590

(22) Filed: Mar. 27, 2013

(65) Prior Publication Data

US 2013/0257066 A1 Oct. 3, 2013

Related U.S. Application Data

(63) Continuation-in-part of application No. PCT/IT2011/000332, filed on Sep. 26, 2011.

(30) Foreign Application Priority Data

Sep. 27, 2010 (IT) ..... RM2010A0498

(51) Int. Cl.
*E05C 1/12* (2006.01)
*D06F 37/42* (2006.01)
(Continued)

(52) U.S. Cl.
CPC ..... *E05C 1/12* (2013.01); *D06F 37/42* (2013.01); *D06F 39/14* (2013.01); *E05B 63/248* (2013.01);
(Continued)

(58) Field of Classification Search
CPC ..... D06F 37/42; D06F 39/14; E05B 63/248
(Continued)

(56) References Cited

U.S. PATENT DOCUMENTS 6,891,722 B2 * 5/2005 Chen ..... E05B 63/248 335/207
7,032,936 B2 4/2006 Promutico
(Continued)

FOREIGN PATENT DOCUMENTS

CN 1882755 12/2006
DE 102007009539 7/2008
(Continued)

OTHER PUBLICATIONS

International Search Report for PCT/IT2011/000332, Completed by the European Patent Office on Dec. 9, 2011, 3 Pages.
(Continued)

*Primary Examiner* — Matthieu F Setliff
*Assistant Examiner* — Thomas L Neubauer
(74) *Attorney, Agent, or Firm* — Brooks Kushman P.C.

(57) ABSTRACT

A system for opening a door, in particular for the door of a household appliance, including a prong, integral with the door, and a device for locking and unlocking the door, having a mechanical module to hold or release the prong, respectively when the door is opened or is closed, the system having an unlocking mechanism arranged on the prong, the unlocking mechanism interacting with the mechanical module after their activation, to release the prong and open the door.

8 Claims, 3 Drawing Sheets

(51) Int. Cl.
*D06F 39/14* (2006.01)
*E05B 63/24* (2006.01)

(52) U.S. Cl.
CPC ..... *Y10T 292/08* (2015.04); *Y10T 292/0999* (2015.04)

(58) Field of Classification Search
USPC ..... 292/341.16
See application file for complete search history.

(56) References Cited

U.S. PATENT DOCUMENTS

| | | | | |
|---|---|---|---|---|
| 2001/0044988 | A1 | 11/2001 | Buscella | |
| 2002/0017793 | A1* | 2/2002 | Spiessl | 292/341.16 |
| 2003/0160461 | A1 | 8/2003 | Promutico | |
| 2004/0140677 | A1* | 7/2004 | Hengelein et al. | 292/201 |
| 2007/0209411 | A1* | 9/2007 | Lim et al. | 70/263 |
| 2008/0238113 | A1* | 10/2008 | Ricchitelli | 292/302 |
| 2009/0320534 | A1* | 12/2009 | Lee et al. | 70/158 |
| 2010/0026015 | A1* | 2/2010 | Joerger et al. | 292/254 |
| 2011/0133490 | A1* | 6/2011 | Berginc | 292/144 |
| 2013/0139556 | A1* | 6/2013 | Eglmeier et al. | 68/13 R |

FOREIGN PATENT DOCUMENTS

| | | |
|---|---|---|
| EP | 1469147 | 10/2004 |
| EP | 1544387 | 6/2005 |
| EP | 1972714 | 9/2008 |
| EP | 2087829 | 8/2009 |
| EP | 2258897 | 12/2010 |
| EP | 1741378 | 7/2013 |
| IT | RM20080062 | 8/2009 |

OTHER PUBLICATIONS

Chinese Office Action for CN201180054215.6, Completed by the Chinese Patent Office, dated Apr. 21, 2015, 3 Pages.
Chinese Office Action for CN201180054215.6, Completed by the Chinese Patent Office, dated Sep. 15, 2014, 6 Pages.
European Office Action for EP 11782680.0, Completed by the European Patent Office, dated Jan. 29, 2014, 4 Pages.
Korean Office Action for KR10-2013-7010566, English translation attached to original, Both completed by the Korean Patent Office, dated Sep. 18, 2015, All together 8 Pages.

* cited by examiner

SYSTEM FOR OPENING A DOOR, IN PARTICULAR FOR THE DOOR OF A HOUSEHOLD APPLIANCE

CROSS-REFERENCE TO RELATED APPLICATIONS

This application is a continuation-in-part of U.S. national phase of PCT Application No. PCT/IT2011/000332 filed Sep. 26, 2011 which claims priority to Italian Application No. RM2010A000498 filed Sep. 27, 2010, the disclosures of which are incorporated in their entirety by reference herein.

TECHNICAL FIELD

The present invention relates to a system for opening a door, in particular for the door of a household appliance.

More specifically, the invention concerns a system that allows the opening by a drive member, arranged directly on the handle of the door, allowing, at the same time, the opening of a door in case of emergency.

In the following, the description will be directed to the installation of the device on a door for a washing machine, but it is clear that the same should not be considered limited to this specific use.

BACKGROUND

As it is well known, the current regulations on the safety of electrical household appliances are becoming more severe. In particular, with regard to the most advanced home appliances, it must be ensured that when the door is closed and the washing machine is operating, the door cannot be opened in any way. When the door is closed and the washing machine is not operating, the door can be opened either by a suitable drive member, so as to allow the opening without any effort, or by applying some preset force to the door. This latter option is required to allow a child, which was introduced in the washing machine, going out, for example by applying a force with his legs on the inner surface of the door. It is also required that, in case of opening of the door due to failure of the prong of the door itself, while the washing machine is operating, the device can "sense" the breaking of said prong and interrupt power supply, and thus the operation of the household appliance.

An example of a device as defined above is described in the patent application RM2008A000062 of the Applicant, which comprises essentially an electric module and a mechanical module interacting each other, in which the drive member to open the door, when the washing machine is turned off, is a button arranged on the control panel of the washing machine, which, by means of a string or an electrical device, activates a lever within the mechanical module, so as to open the door.

At present, market requires that the opening of the door can be made in a more and more comfortable and ergonomic way. In particular, the arrangement of the opening drive member drive directly on the door handle of the door, or in general on the surface of the latter, is required.

A technical difficulty encountered for this kind of operation is due to the fact that the space available for implementing a mechanism or a device generally capable of interacting with the door lock to open the door, is very small, in particular for washing machines, where, for security and sealing reasons, practically there is not closing overrun.

In view of the above, it is an object of the present invention to provide a system for opening a door that can be activated by a drive member arranged on the handle of the door itself.

These and other results are obtained according to the invention with a drive member, like a button or a lever, arranged on the handle by which the movement of a member arranged on the prong of the door can be controlled, said member being capable to interact with the mechanical module of the device to open the door.

SUMMARY

It is therefore a specific object of the present invention a system for opening a door, in particular for the door of a household appliance, including a prong, integral with said door, and a device for locking and unlocking said door, having a mechanical module to hold or release said prong, respectively when said door is open or is closed, said system being characterized in that it comprises unlocking means arranged on said prong, said unlocking means interacting with said mechanical module after their activation, to release said prong and open said door.

Always according to the invention, said unlocking means could comprise an unlocking member, slidably coupled with said prong, said unlocking member providing an elongated portion having one end, a driving member, such as a button or the like, and returning means, like a spring or the like.

Still according to the invention, said end of said elongated portion of said unlocking member could be tapered towards the free top of said prong.

Further according to the invention, said driving member could be operated by the handle of said door or by a further member.

Advantageously according to the invention, said driving member could be operated by a further member integral with said door.

Always according to the invention, said device could comprise a containment enclosure, an electric module having a blocking and activating pin, capable to assume an operating position, wherein it is extracted so as to inhibit the operation of said device preventing the opening of said door, and a rest position, wherein said blocking and activating pin is retracted, said hook of said mechanical module is rotating and is pivoted on said containment enclosure, and said hook includes returning means, such as a spring, and said mechanical module further comprises a blocking slider engaging with said blocking and activating pin when the latter is in said operating position, a strut horizontally moving, connected with said blocking slider, interacting with said hook and provided with a tooth, a safety slide, parallel with respect to said strut, provided with a projection and a recess, so that when said prong is not engaged with said hook, said safety slide assumes a rest position, wherein said projection is overlapped with respect to an opening of said enclosure so as to prevent said blocking and activating pin to be extracted; and when the prong is engaged with the hook, said safety slide assumes a first position in which it interferes with said end of said unlocking member and allows said pin to assume said operating position, so that after the operation of said driving member, said end of said unlocking member moves said safety slide so that said recess interacts with said tooth of the said strut, disengaging the latter from said hook.

The present invention will be now described, for illustrative but not limitative purposes, according to its preferred embodiments, with particular reference to the figures of the enclosed drawings, wherein:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In the various figures, similar parts will be indicated by the same reference numbers.

Figure 1:
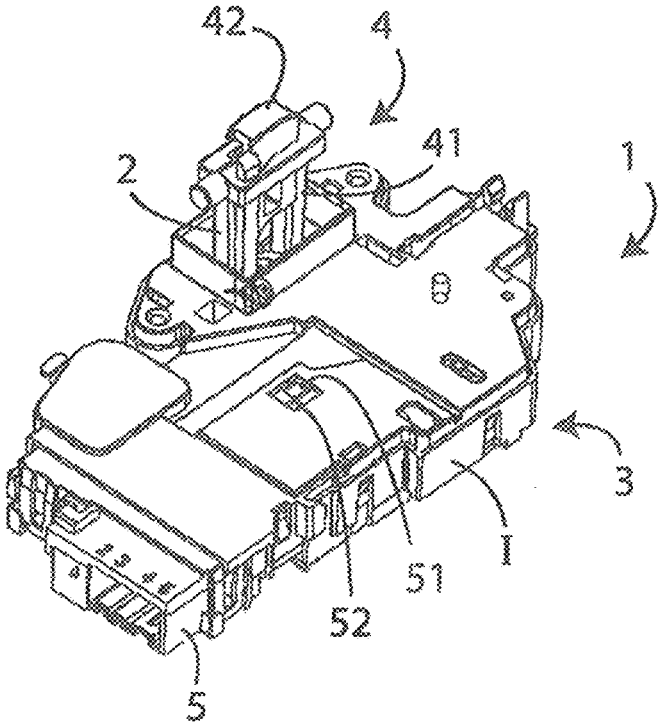
FIG. 1 shows a first perspective view of a system for opening a door according to the present invention.
Figure 2:
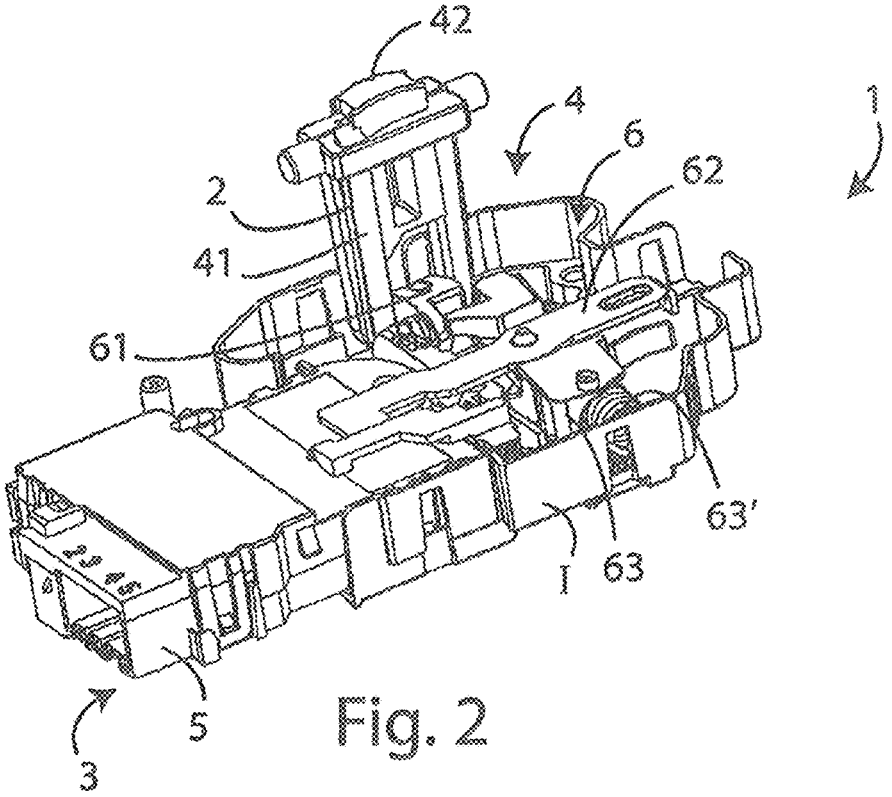
FIG. 2 shows a second perspective view of a system for opening a door according to the present invention.
Figure 3A:
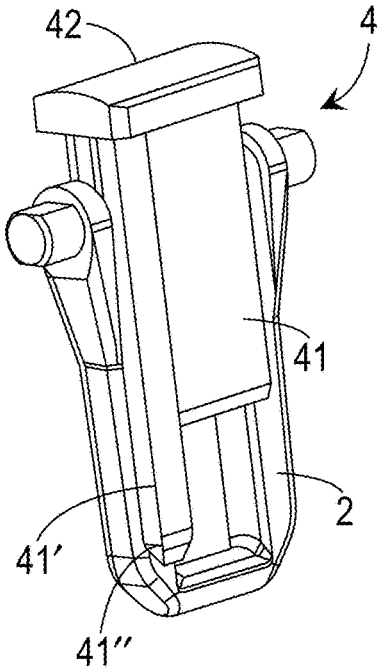
FIG. 3A shows a perspective view of a household appliance door prong.
Figure 3B:
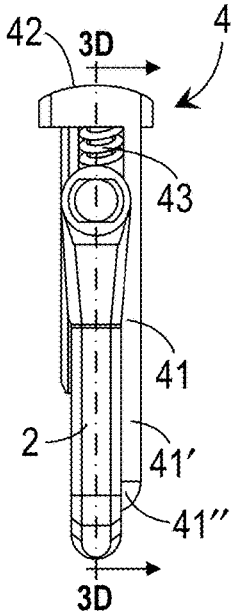
FIG. 3B shows a longitudinal view of the prong of FIG. 3A.
Figure 3C:
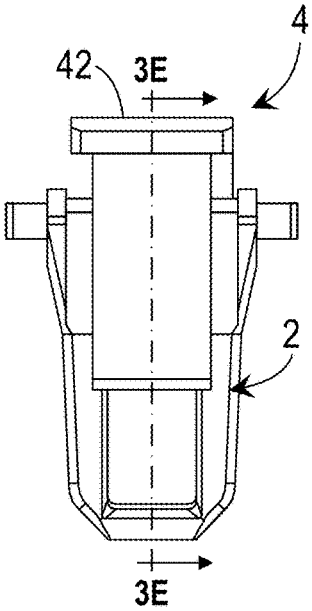
FIG. 3C shows a rear view of the prong of FIG. 3A.
Figure 3D:
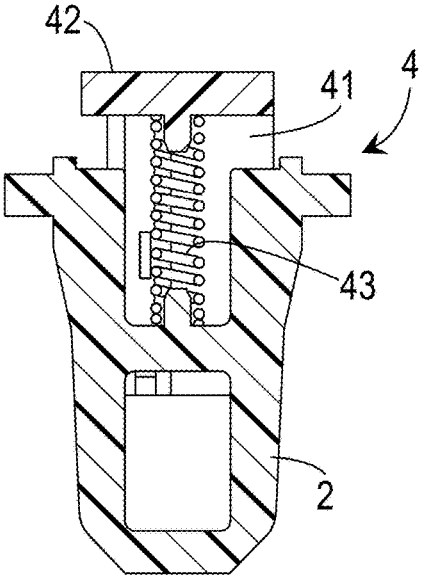
FIG. 3D shows a plan section of the prong of FIG. 3A.
Figure 3E:
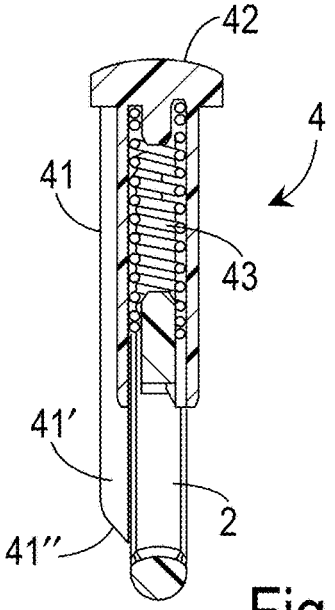
FIG. 3E shows a longitudinal section of the prong of FIG. 3A.

Referring to FIGS. 1 and 2, a system 1 for opening a door (the latter is not shown in the figures) of a household appliance, like a washing machine, can be seen.

The system 1 comprises a prong 2 integral with the door, and a device 3. Unlocking means 4 are installed on the prong 2.

Said unlocking means 4, referring to FIGS. 3A-3E, comprise a unlocking member 41, slidably coupled with said prong 2, that has an elongated portion 41', one of whose ends 41" is tapered toward the free top of the prong 2, a button 42 and a return spring 43. A pressure exerted by a finger on said button 42 causes a compression of the spring and a slide of said unlocking member 41 parallel to said prong 2.

Said device 3 comprises an electric module 5 and a mechanical module 6.

The electric module 5 is connected with a logical unit of the household appliance and comprises a blocking and activating pin 51, capable of assuming an operating position, in which it is extracted and capable to be arranged through an opening 52, obtained from the enclosure I, and to inhibit the operation of the mechanical module 6, and a rest position, in which said blocking and activating pin 51 is retracted.

The mechanical module 6 comprises a rotating hook 61, pivoted with the enclosure I and provided with a suitable spring 61'. Said rotating hook 61 is capable to engage with said prong 2 when the door is in closed position.

Said mechanical module 6 further comprises a strut 63 horizontally movable, interacting with the rotating hook 61 and provided, also, with a return spring 63'. When prong 2 intercepts the hook 61, the latter rotates contrasting the action of said return spring 63'. Said strut 63 is positioned in a suitable profile of hook 61, while remaining engaged with said prong 2. Said strut 63 also has a tooth 63", which function will be better explained below. Said return spring of strut 63 is arranged eccentrically with respect to the rotation center of the strut 63, thus generating both a rotary and an axial motion.

Said mechanical module 6 also includes a blocking slider 62, connected with said strut 63. Said blocking slider 62 can assume a first position and a second position. In this first position, the door is closed, the prong 2 is engaged with said rotating hook 61 and said slider 62 is arranged so as to keep the window 52 open. Thus, the blocking and activating pin 51 can prevent the movement of said slider 62, and thus the opening of the door, when it is extracted (door closed and washing machine turned on).

In said second position, the door is opened, prong 2 is disengaged from said rotating hook 61 (door opened) and said slider 62 is arranged so as to be placed over the window 52. The blocking and activating pin 51 is necessarily in the retracted position.

When the blocking and activating pin 51 is retracted, for example when the washing machine is turned off and has finished to operate, it releases the slider 62, which can move from said first to said second position to allow the disengagement of said strut 63 from said rotating hook 61 and to open the door.

Said mechanical module 6 also includes a safety slide 64, provided with a return spring 64' and having a projection 64". Said safety slide 64 also has a recess 64'" and is arranged parallel to said strut 63.

Safety slide 64 is arranged so that when prong 2 is not engaged with said hook 61, said safety slide 64 assumes a rest position, in which the projection 64" overlaps said opening 52, so as to prevent said blocking and activating pin 51 to be extracted.

Figure 4:
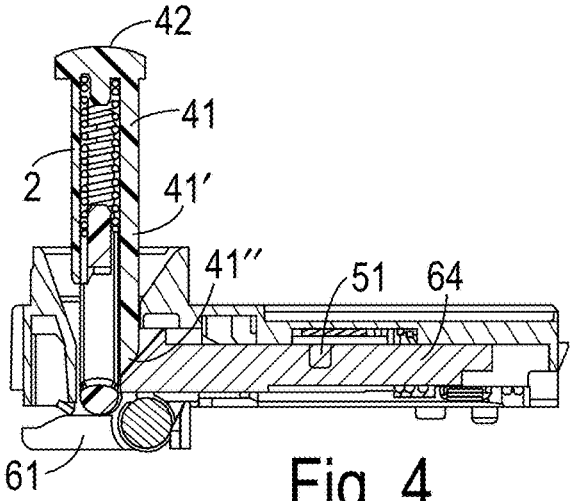
FIG. 4 shows a prong engaged with a lock-unlock hook.

When prong 2 is engaged with said hook 61 (refer to FIG. 4) said safety slide 64 assumes a first position, in which it interacts with said prong 2 and with the end 41" of said unlocking member 41. In this first position, projection 64" arranges so as to allow the blocking and activating pin 51 to be extracted and to be arranged through said opening 52, allowing, in other words, the activation of the washing machine.

In this first position, emergency opening of the door is also possible, with a push from inside of the machine (safety function for children). This emergency opening is guaranteed by the push that the hook 61 transmits to the strut 63, which, subjected to a predetermined force, can translate and rotate for the movement due to the contact of the profile of the strut 63. Said strut 63 disengages, making a rotation, releasing the hook 61 and thus the prong 2 of the door.

Furthermore, said safety slide 64, in case of failure or tampering of prong 2, e.g. for breaking, tends to return in said rest position, possibly by retracting said blocking pin 51, thus turning off the washing machine.

Figure 5:
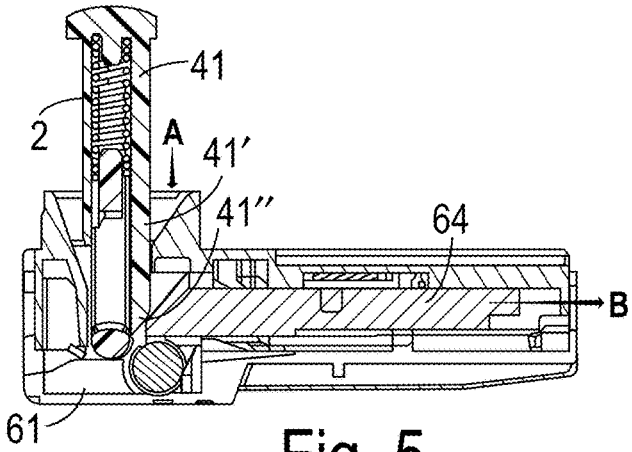
FIG. 5 shows a prong that is disengaged from the lock-unlock hook.
Figure 6:
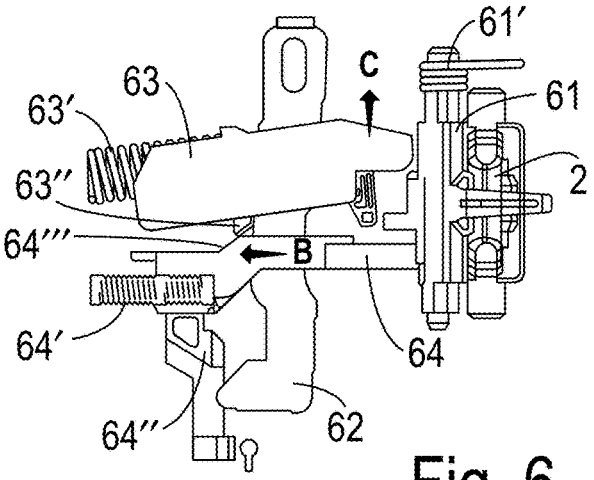
FIG. 6 shows the prong of FIG. 5 that is disengaged from the lock-unlock hook.

For opening the door (see FIGS. 5 and 6), when the washing machine is turned off and thus the blocking and activating pin 51 is retracted, the button 42 has to be pressed. In this way, unlocking member 41 slides parallel with respect to said prong 2 along the direction indicated by arrow A, the end 41" of unlocking member 41, by its tapered profile, moves said safety slide 64 along the safety direction of the arrow B, further contrasting the action of the return spring 64'. Said safety slide 64, therefore, assumes a second position in which the recess 64''' and tooth 63'' of said strut 63, interact, causing the disengagement of said strut 63, moving it according to the arrow C, from said hook 61, which under the effect of return spring 61', rotates and releases prong 2.

As it can be seen, the solution according to the present invention, allows the interaction with the release mechanism of the device 3 by acting on a drive member placed on the door.

Different kinds of commands on the door can be realized, in addition to the button (i.e. pressure driving), as, for example, a pulling or rotating pressure lever and the like, providing an appropriate shape of the end 41'' of the elongated portion 41' of the unlocking member 41 in general, and an appropriate coupling between driving member and the unlocking member 41.

Placing the opening driving member on the handle or in any other position of the door is also possible.

The present invention has been described for illustrative but not limitative purposes, according to its preferred embodiments, but it is to be understood that modifications and/or changes can be introduced by those skilled in the art without departing from the relevant scope as defined in the enclosed claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for opening a door of a household appliance, comprising:

a prong, integrally attachable to an appliance door at a fixed end and having a free U-shaped end for projecting outwardly from an inside surface of the door, a lock mechanism mountable to a door frame and cooperating with the prong U-shaped end to lock and unlock said door, having a spring biased mechanical latch to hold or release the U-shaped end of said prong, when said door is in a latched or unlatched state respectively, and an unlocking bar arranged on said prong and slidable relative thereto, said unlocking bar having an outward end and an inward end for engaging the latch, the unlocking bar being inwardly moveable against a spring to interact with said spring biased mechanical latch, and after activation, to release said prong U-shaped end and open said door.

2. The system according to claim 1, wherein said free end of unlocking bar is tapered towards a free end of said prong.

3. The system according to claim 1, wherein said unlocking bar outside end is operated by a handle of said door.

4. The system according to claim 1, wherein said unlocking bar outside end is operated by a further member integral with said door.

5. The system according to claim 1, further comprising:

a containment enclosure, an electric module having a blocking and activating pin, capable to assume an operating position, wherein it is extracted so as to inhibit movement of the mechanical latch preventing the opening of said door, and a rest position, wherein said blocking and activating pin is retracted, a hook in the lock mechanism which pivots on said containment enclosure, and said hook is biased by a hook return spring, and in that said lock mechanism further comprises a blocking slider engaging with said blocking and activating pin when the latter is in said operating position, a strut horizontally moving, connected with said blocking slider, interacting with said hook and provided with a tooth, a safety slide, parallel with respect to said strut, provided with a projection and a recess, so that when said prong is not engaged with said hook, said safety slide assumes a rest position, wherein said projection is overlapped with respect to an opening of said enclosure so as to prevent said blocking and activating pin to be extracted; and when the prong is engaged with the hook, said safety slide assumes a first position in which it interferes with said end of said unlocking member and allows said pin to assume said operating position, so that after the operation of said driving member, said end of said unlocking member moves said safety slide so that said recess interacts with said tooth of the said strut, disengaging the latter from said hook.

6. The system according to claim 1, wherein said unlocking bar is slidably coupled with and supported by said prong, the unlocking bar providing an elongated portion having one end, and an unlocking bar return spring, and the end of said elongated portion of said unlocking bar being tapered towards a free end of said prong to push the prong free end and the latch bar apart when the unlocking bar is urged inwardly overcoming the force of the unlocking bar return spring.

7. A system for opening a household appliance door, the system comprising:

a prong, integrally attachable to a household appliance door, a lock mechanism mountable to a door frame for locking and unlocking said door, having a mechanical latch to hold or release said prong, respectively when said door is open or is closed, and an unlocking bar arranged on and supported by said prong, said unlocking bar interacting with said mechanical latch after activation, to release said prong free end and enable the door to open, wherein said unlocking bar is slidably coupled with and supported by said prong, the unlocking bar providing an elongated portion having one end, and an unlocking bar return spring, and the end of said elongated portion of said unlocking bar being tapered towards a free end of said prong to push the prong free end and the latch bar apart when the unlocking bar is urged inwardly overcoming the force of the unlocking bar return spring.

8. The system according to claim 7, wherein the prong is integrally attachable to an appliance door at a fixed end and has a free U-shaped end for projecting outwardly from an inside surface of the door.

* * * * *